US005228239A

United States Patent [19]

Heo

[11] Patent Number: 5,228,239

[45] Date of Patent: Jul. 20, 1993

[54] SYSTEM FOR AUTOMATICALLY OPENING AND CLOSING DOORS OF VEHICLES

[75] Inventor: Chang I. Heo, Kwangju, Rep. of Korea

[73] Assignee: Asia Motors Co., Inc., Seoul, Rep. of Korea

[21] Appl. No.: 917,637

[22] Filed: Jul. 22, 1992

[30] Foreign Application Priority Data

May 28, 1992 [KR] Rep. of Korea ..... 1992-9138

[51] Int. Cl.[5] ..... E05F 15/00

[52] U.S. Cl. ..... 49/280; 49/334

[58] Field of Search ..... 49/280, 334, 335, 324

[56] References Cited

U.S. PATENT DOCUMENTS

| | | | |
|---|---|---|---|
| 2,116,446 | 5/1938 | Nishimura | 49/280 |
| 2,628,091 | 2/1953 | Rappl | 49/280 X |
| 2,726,893 | 12/1955 | Zucker | 49/280 |
| 3,124,344 | 3/1964 | Mano | 49/280 |
| 3,195,879 | 7/1965 | Bond et al. | 49/334 X |
| 3,319,380 | 5/1967 | Loftus | 49/334 X |

*Primary Examiner*—Philip C. Kannan

*Attorney, Agent, or Firm*—Lowe, Price, LeBlanc & Becker

[57] ABSTRACT

A system for automatically opening and closing a door of a vehicle is disclosed. The system comprises an oil-hydraulic pump for generating hydraulic power for the system and a pressure accumulator for removing pressure pulsations generated in the pressurized oil outputted from the oil-hydraulic pump. A pressure control valve controls a flow direction of the pressurized oil applied from the oil-hydraulic pump thereto, and a controller controls the pressure control valve in response to input signals. An intermittent gearing assembly transmits rotational motion caused by the pressurized oil acting thereon to the door to automatically open or close the door. A hydraulic rotator converts the hydraulic power of the pressurized oil into rotational motion of the intermittent gearing assembly. A longitudinal lock bar movable in response to intermittent gearing motion locks and unlocks the door relative to the vehicle frame.

7 Claims, 7 Drawing Sheets

SYSTEM FOR AUTOMATICALLY OPENING AND CLOSING DOORS OF VEHICLES

BACKGROUND OF THE INVENTION

1. Field of the Invention

The present invention relates in general to a system for automatically opening and closing doors of vehicles by means of a switch equipped in the vehicle or a remote controller, and more particularly to a system for automatically opening and closing doors of vehicles which comprises a hydraulic pump and a pressure control valve, each connected to intermittent gearing assembly and operated in response to signals outputted from switch or the remote controller, thereby automatically opening and closing the doors and manually opening and closing the doors when the manual operation is required.

2. Description of the Prior Art

Known automatic door opening and closing system for vehicles is generally classified in accordance with the driving power source into two types, that is, an hydraulic cylinder type system in which an oil-hydraulic cylinder or a pneumatic cylinder is used for driving the door and a motor type system in which a chain gearing is used for transmitting the rotating power of a motor to the door. The one type of system provides a relatively high power to the door as a result of using the hydraulic power for the driving power so that this type of system is generally equipped in medium and large-size vehicles, such as medium and large-size passenger buses, having large and heavy doors, while the other type of system generates a relatively low power so that this type of system is generally used in a small-size passenger bus.

However regardless of the types, the known automatic door opening and closing system has a complex mechanism comprising a lot of elements such as for generating the driving power and transmitting the driving power to the doors. The system is thus obliged to occupy a substantial space inside the vehicles, thereby causing the spacial efficiency of the vehicles to be reduced. In result, such system has a disadvantage in that it is used within the limits of the middle or large-size vehicle which can provide an additional inner space for accommodating it, furthermore, it occupies a large part of the inner space of the vehicle as described above such that the casing enclosing this system generally juts out into the inner space of the vehicle and this causes the interior beauty of the vehicle to be spoiled.

In addition, during an automatic opening or closing operation of the door using the known automatic door opening and closing system, the system can not be manually operated to reverse the operation but continuously imparts the driving power to the door until the desired operation is accomplished. Therefore, if a person is sandwiched between the car frame and the door in the opening or closing operation, the person may be seriously injured by the door continuously imparted with the driving power by the system. On the other hand, if a hard foreign substance gets between the car frame and the door in operation, the car frame or the door is possible to be damaged.

The known automatic door opening and closing system is, therefore, not equipped in a small-size passenger vehicle such as a deluxe motorcar which provides a small inner space and takes a serious view of the interior beauty. Furthermore, almost the small-size vehicles such as the deluxe motorcars and the trucks are provided with integral type doors each of which is hinged to the car frame by hinged connections mounted between the car frame and a periphery of the door and is turned about the hinged connections to be opened or closed, while the buses are conventionally equipped with doors each of which linearly slides along the rails provided at the car frame or is folded at the vertical center line thereof simultaneously with turning about hinged connections provided between the car frame and the door. In result, there occurs a technical problem in employing the known system to the small-size vehicle having the aforementioned doors in consideration of the structure of the doors.

On the other hand, there has been proposed a door opening and closing system for small-size vehicles, for example, a system in which an expansion and contraction bar connected to the door and cooperating with an actuating lever, the lever being arranged adjacent the driver seat, expands or contracts in response to the driver's operation of the actuating lever to make the door be rotated about the hinged connections. However in this type of system, the doors are opened or closed by the driving power caused by the driver's operation of the actuating lever and simply transmitted from the actuating lever thereto by way of the expansion and contraction bar so that this system is not identified as a class of the automatic system but a manually operated system. Additionally, this system is conventionally equipped in the deluxe motorcars to allow the driver to manually open a back door for the passengers in the back seats so that it has a disadvantage in that it is inconvenient to open or close the door and may cause a serious traffic accident to occur due to a sudden opening of the door during a high speed running of the car.

SUMMARY OF THE INVENTION

It is, therefore, an object of the present invention to provide system for automatically or manually opening and closing the doors of vehicles in which the above-mentioned disadvantages can be overcome and which has such compact structure that it is efficiently equipped in small-size vehicles such as a small-size passenger car and a truck as well as middle and large-size vehicles such as buses and is automatically and manually operated, thereby preventing the interior beauty of the vehicles from being spoiled and preventing the person or the door from being injured or being damaged during the opening and closing operations of the door.

To achieve the above-mentioned object, this invention provides a system for automatically opening and closing a door of a vehicle comprising: an oil-hydraulic pump for pressurizing oil which is applied from an oil reservoir thereto and outputting the pressurized oil; a pressure accumulator for removing a pressure pulsation generated in the pressurized oil outputted from said oil-hydraulic pump, said pressure accumulator being disposed on an output side of the oil-hydraulic pump; a pressure control valve for controlling a flow direction of the pressurized oil which is applied from the oil-hydraulic pump thereto by way of said pressure accumulator; a controller for controlling said pressure control valve in response to input signals, said controller being electrically connected to said pressure control valve; an intermittent gearing assembly for transmitting a rotational motion cause by the pressurized oil to said door so as to make the door be automatically opened or closed, said intermittent gearing assembly comprising a cylindrical drive intermittent gear rotating above a drive shaft fixed to a vehicle frame and a cylindrical driven intermittent gear engaging with said drive intermittent gear and rotating together with the drive intermittent gear in order to rotate a driven shaft fixed to the door; a hydraulic rotator for converting the hydraulic power of the pressurized oil into the rotational motion of said intermittent gearing assembly, said hydraulic rotator comprising a pair of variable oil chambers which are formed in said drive intermittent gear and communicate with said pressure control valve, respectively; and a longitudinal lock bar for locking the door to the vehicle frame, said longitudinal lock bar being connected at an end thereof to a connection ring provided at an outer surface of the driven intermittent gear.

BRIEF DESCRIPTION OF THE DRAWINGS

The above and other objects, features and other advantages of the present invention will be more clearly understood from the following detailed description taken in conjunction with the accompanying drawings, in which:

FIGS. 5 and 6 are sectioned views showing rotating operations of the intermittent gearing assembly of FIG. 3, in which:

FIG. 5 shows a balanced state wherein the inner pressures of a pair of oil chambers formed in a drive gear are balanced to each other; and FIG. 6 shows a counterclockwise rotation of the drive gear during the opening operation of the system;

DETAILED DESCRIPTION OF THE PREFERRED EMBODIMENTS

Figure 1:
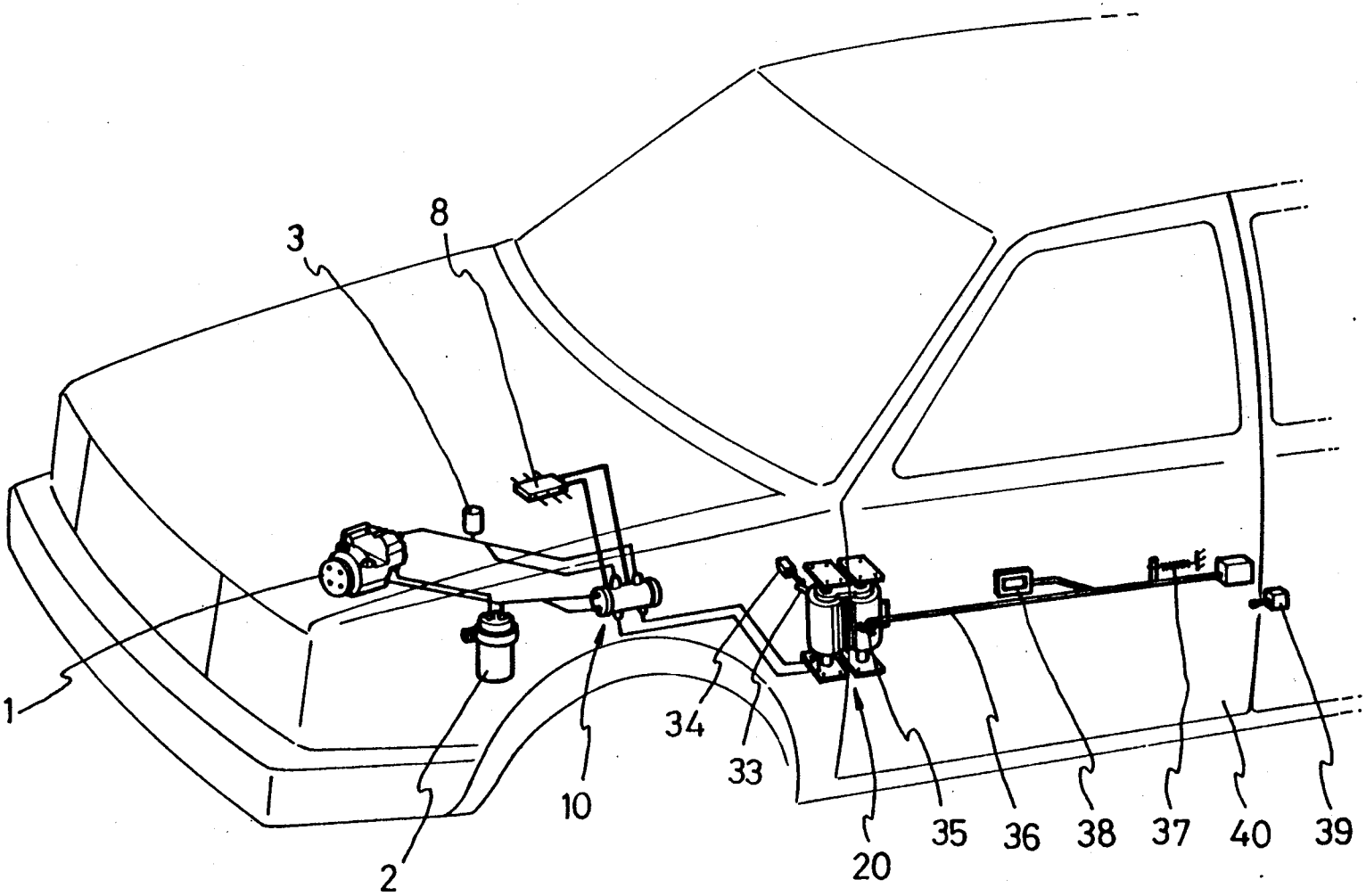
FIG. 1 is a schematic perspective view showing a structure of a system for automatically opening and closing doors of vehicles in accordance with the present invention.

Referring now to FIG. 1 showing a structure of a system for automatically opening and closing doors of vehicles in accordance with this invention, the system comprises an oil-hydraulic pump 1 (hereinafter, referred to simply as "the oil pump") provided to generate a hydraulic power, that is, a driving power for the system, an oil reservoir 2 connected to an input port of the oil pump 1 and containing oil under the atmospheric pressure, a hydraulic pressure control valve 10 (hereinafter, referred to simply as "the control valve") connected to an output port of the oil pump 1 and also connected to a controller 8. In addition, a pressure accumulator 3 is disposed on a hydraulic line between the oil pump 1 and the control valve 10. The control valve 10 is also connected at its drain port to the oil reservoir 2 by means of a drain line.

Figure 3:
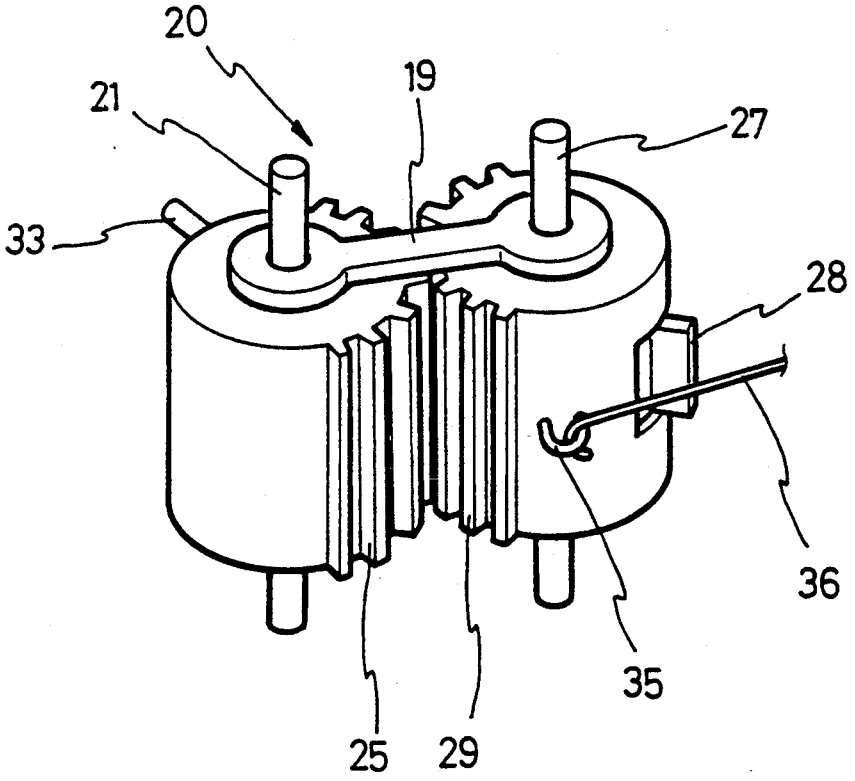
FIG. 3 is a perspective view showing an intermittent gearing assembly of the system of FIG. 1.
Figure 4:
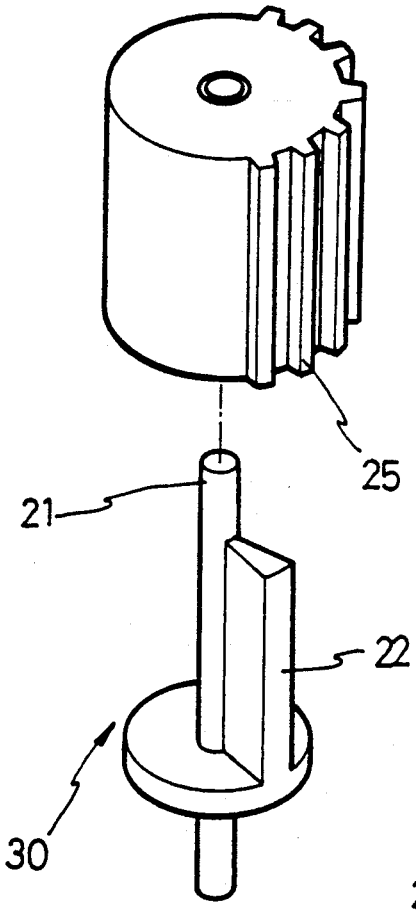
FIG. 4 is an exploded perspective view showing a hydraulic rotator of the intermittent gearing assembly of FIG. 3.

The control valve 10 is then connected at its output side to an intermittent gearing assembly 20 which is operated by the hydraulic power transmitted from the control valve 10 in the manner as will be described in detail hereinafter. With further reference to FIGS. 3 and 4, the intermittent gearing assembly 20 includes a hydraulic rotator 30 having a drive intermittent gear 25 and a driven intermittent gear 29. At a side of the drive intermittent gear 25, a first sensor 34 is mounted in order to sense the opening or closing state of a door 40 according to the rotation of the drive intermittent gear 25. A longitudinal lock bar 36 is connected at an end thereof to a side surface of the driven intermittent gear 29 to lock or release the door 40 with respect to the car frame.

The lock bar 36 is provided at its center with a release lever 38 which is manually pulled to open the door as required. On the other hand, a biasing member 37 such as a tension coil spring is arranged at the other end of the lock bar 36 by being elastically connected between a hook projection provided at the lock bar and a mount of the door 40 so that the released lock bar 26 is elastically restored to the locking state with respect to a locking hole of the car frame without failure. In addition, a second sensor 39 is disposed at a position of the car frame facing a free end of the door 40 to sense the closed state of the door 40.

Figure 2:
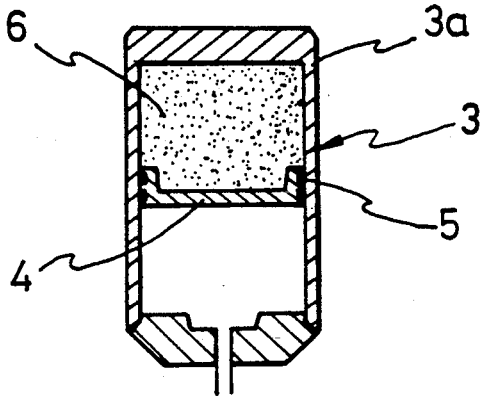
FIG. 2 is an elevational sectioned view of a pressure accumulator of the system of FIG. 1.

Turning to FIG. 2 showing a structure of the pressure accumulator 3 disposed on the hydraulic line between the oil pump 1 and the control valve 10, the accumulator 3 comprises a cylindrical housing 3*a* enclosing a piston 4 which is provided with oil rings 5 and divides the inner space of the housing 3*a* into two parts, that is, an upper part charged with high pressure nitrogen gas and a lower part communicated with the hydraulic line between the oil pump 1 and the control valve 10, so that it removes the pressure pulsation generated in the pressurized oil outputted from the oil pump 1 to the control valve 10.

FIG. 3 shows a structure of the intermittent gearing assembly 20 comprising the cylindrical drive and driven intermittent gears 25 and 29. As depicted in the drawings, the drive intermittent gear 25 (hereinafter, referred to simply as "the drive gear") engages with the driven intermittent gear 29 (hereinafter, referred to simply as "the driven gear") and maintains a predetermined space with respect to the driven gear 29 by means of a pair of spacers 19 each of which is arranged at upper or lower ends of the gears 25 and 29. Each spacer 19 engages at an end thereof with a separate member of drive shaft 21 inserted in the drive gear 25 and at the other end thereof with a separate member of driven shaft 27 inserted in the driven gear 29. In result, the gears 25 and 27 are spaced apart from each other by the predetermined distance and this improves the engaging efficiency between the gears 25 and 29. Here, the drive gear 25 rotates about the drive shaft 21 fixed to the car frame, while the driven gear 29 rotates about the driven shaft 27 fixed to the door 40.

The driven shaft 27 fixed to the door 40 includes a narrow, vertical stopper 28 which engages with a rectangular opening 29a formed at a side surface of the driven gear 29 so that the relative rotation of the driven gear 29 with respect to the driven shaft 27 is limited within a predetermined angular range. Therefore, if the driven gear 29 continuously rotates after the stopper 28 of the driven shaft 27 contacts with a side periphery of the opening 29a by a relative rotation of the driven gear 29 with respect to the driven shaft 27, the driven shaft 27 rotates together with the driven gear 29 and this causes the door 40 fixed to the driven shaft 27 to turn about the hinged connections to be opened or closed. On the other hand, to connect the one end of the longitudinal lock bar 36 to the side surface of the driven gear 29, the driven gear 29 is provided at the side surface thereof with a connection ring 35 on which the one end of the lock bar 36 hooks.

Figure 5:
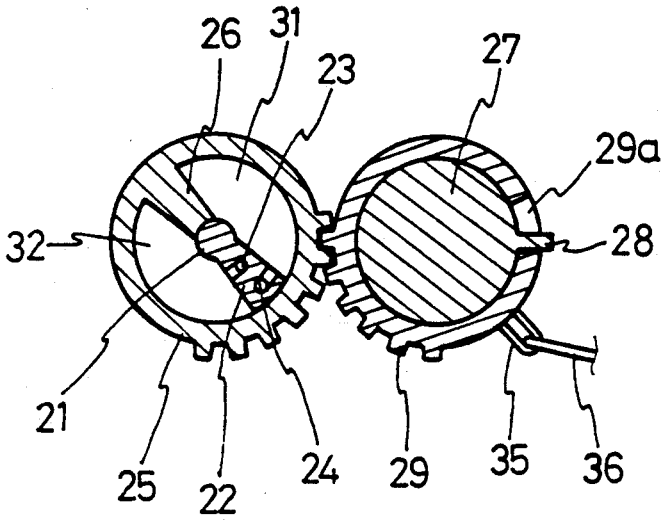
Figure 6:
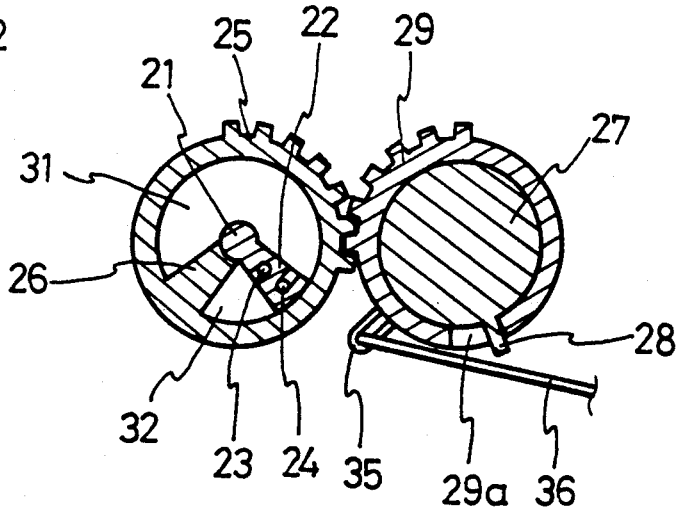

Turning to FIGS. 4 to 6 showing a structure and a rotational operation of the intermittent gear assembly, the cylindrical drive gear 25 has a movable vertical partition 26 radially inwardly projecting from an inner surface thereof to a distance equal to the inner radius thereof (see FIGS. 5 and 6), while the drive shaft 21 is integrally provided with a stationary vertical partition 22 radially outwardly projecting from an outer surface thereof to an extend that the outer end of the partition 33 closely contacts with the inner surface of the drive gear 25 (see FIGS. 4 to 6). In result, if the drive gear 25 engages with the fixed drive shaft 21, the inner space of the drive gear 25 is divided into two oil chambers 31 and 32 of which the volumes are varied according to the relative rotation of the drive gear 25 about the drive shaft 21. The drive gear 25 in cooperation with the drive shaft 21 thus provides a hydraulic rotator 30 which rotates the driven shaft 27 as well as the driven gear 29. Here, the vertical partition 22 of the drive shaft 21 has a pair of oil circulation holes 23 and 24 for causing the pressurized oil to flow in and to be discharged from the chambers 31 and 32.

Figure 7:
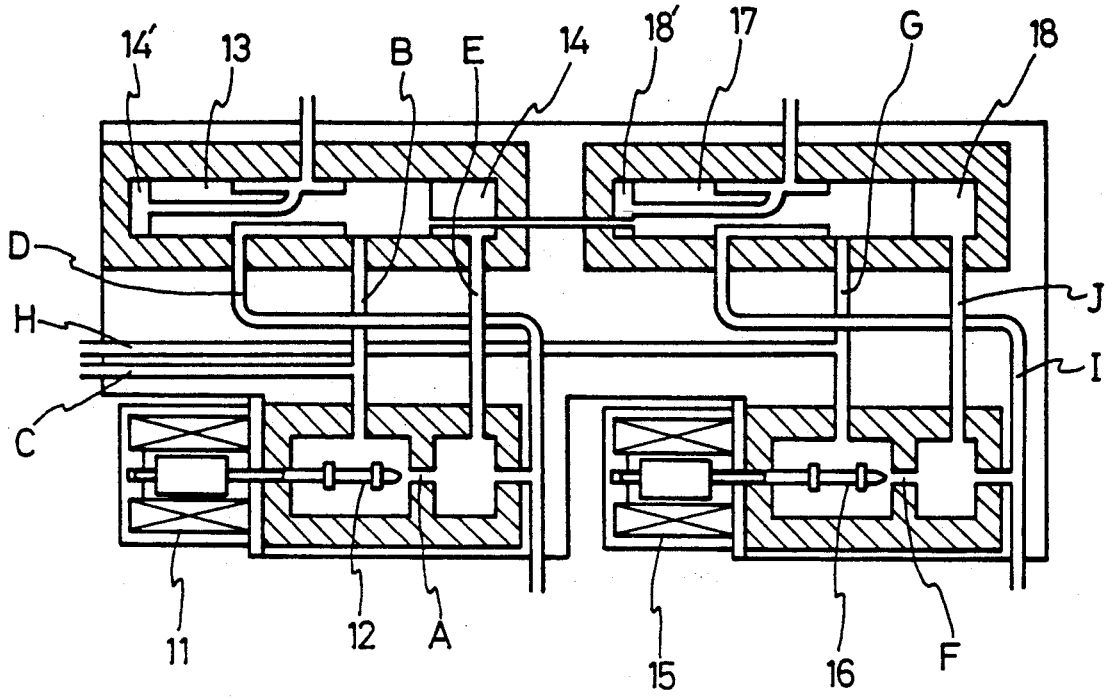
FIG. 7 is a sectioned view showing a structure of a pressure control valve of the system of FIG. 1.
Figure 8:
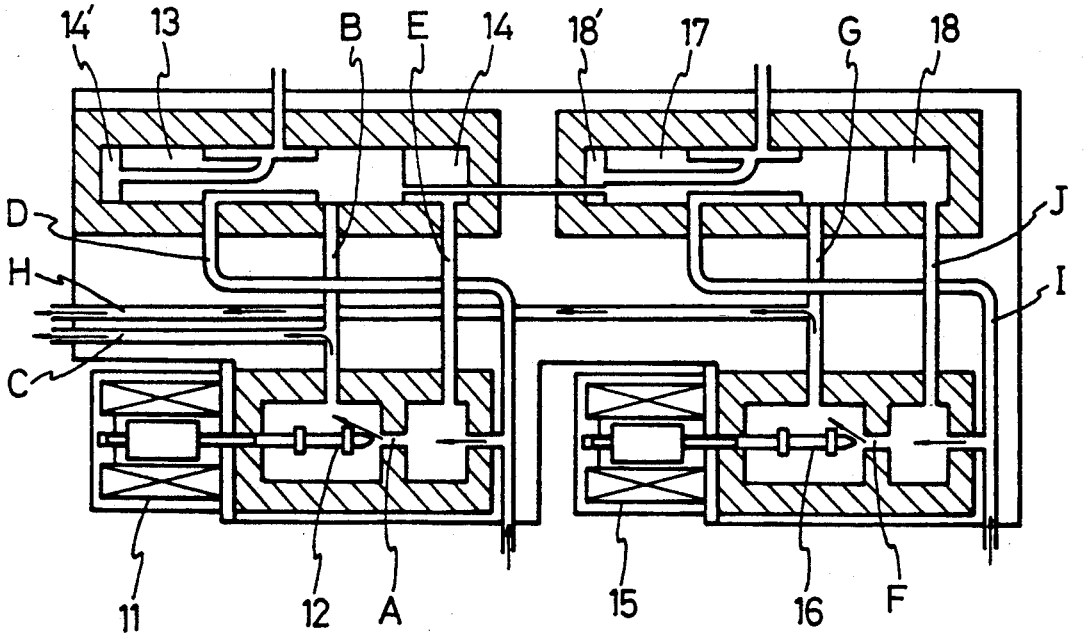
FIG. 8 is a sectioned view of the pressure control valve showing a flow direction of the pressurized oil when the system stops its operation.

FIGS. 7 and 8 are sectioned views showing the structure of the solenoid control valve 10. The control valve 10 includes at the input side thereof a pair of solenoids 11 and 15, each comprising a coil and a movable core, and at the output side thereof a pair of spools 13 and 17. The spools 13 and 17 are connected to each other by means of a connection bar and each provides at both sides thereof variable oil chambers 14, 18 and 14', 18' into which the pressurized oil outputted from the oil pump 1 and a feedback pressure discharged from the hydraulic rotator 30 of the intermittent gearing assembly 20 are applied, respectively, so that they axially move in response to the pressurized oil and the feedback pressure applied to the variable oil chambers 14, 18 and 14', 18'. As shown in the drawings, the core of each solenoid 11 or 15 is fixedly connected at its free end to a needle 12 or 16 which axially moves depending upon the axial movement of the core. If the needle 12 or 16 moves rightwards by the rightward movement of the core of the solenoid 11 or 15, the needle 12 or 16 reduces the orifice area of a hydraulic passage A or F so that the pressurized oil applied to the input side of the control valve 10 flows upwardly to the output side of the solenoid valve 10.

In operation of this system having the aforementioned structure, the oil pump 1 is operated to cause the oil supplied from the oil reservoir 2 to be pressurized from the atmospheric pressure to a predetermined high pressure and continuously feeds the pressurized oil to the control valve 10 through the hydraulic line having the pressure accumulator 3. Here, the pressure pulsation generated in the pressurized oil flowing in the hydraulic line is removed by means of the pressure accumulator 3 in the manner as described above. Upon receiving the pressurized oil, the control valve 10 controls the flow direction of the pressurized oil in response to a signal applied from the opening or closing switch equipped in the vehicle or the remote controller operated by the driver and supplies the pressurized oil to the intermittent gearing assembly 20. At this time, the signal is applied to the control valve 10 by way of the controller 8. In result, the drive gear 25 of the hydraulic rotator 30 rotates about the drive shaft 21 owing to a pressure difference between the oil chambers 31 and 32 and this causes the driven gear 29 engaging with the drive gear 25 to rotate about the driven shaft 27. After the predetermined relative rotation of the driven gear 29 with respect to the driven shaft 27, the driven gear 29 rotates together with the driven shaft 27 fixed to the door 40, thereby causing the door 40 to be automatically opened or closed in accordance with the driver's operation.

That is, regardless of the opening or closing state of the door 40, when no signal is applied from the opening or closing switch to the controller 8, the solenoids 11 and 15 of the control valve 10 are not operated as shown in FIG. 8 so that the needles 12 and 16 do not move rightwards. In result, the hydraulic passages A and F of the input side of the control valve 10 maintain their opening states so that the pressurized oil applied from the oil pump 1 to the input side of the control valve 10 is simply drained to the oil reservoir 2 through the passage A and F and the drain lines C and H.

In accordance, when the opening or closing switch is not operated, the one oil chamber 31 of the hydraulic rotator 30 has the same inner pressure as that of the other oil chamber 32 regardless of positions of the spools 13 and 17. Thus, the drive gear 25 of the hydraulic rotator 30 is not rotated about the drive shaft 21 so that it does not cause the door 40 to be opened or closed.

Figure 9:
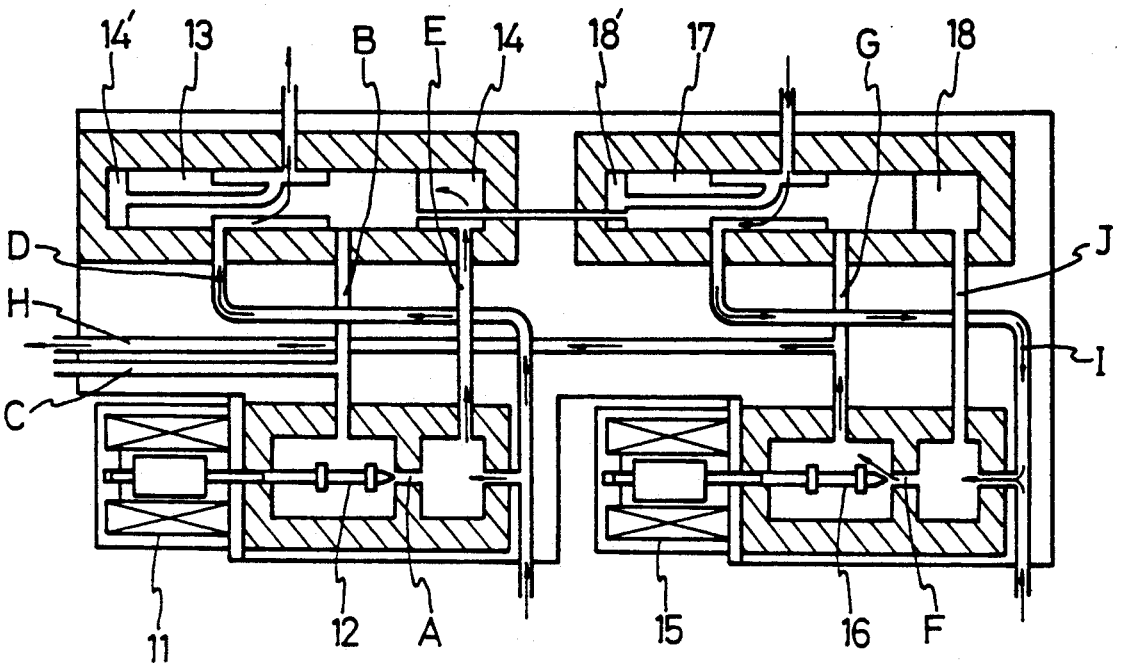
FIG. 9 is a view corresponding to FIG. 8, but showing a flow direction when the system performs the door opening operation.
Figure 10:
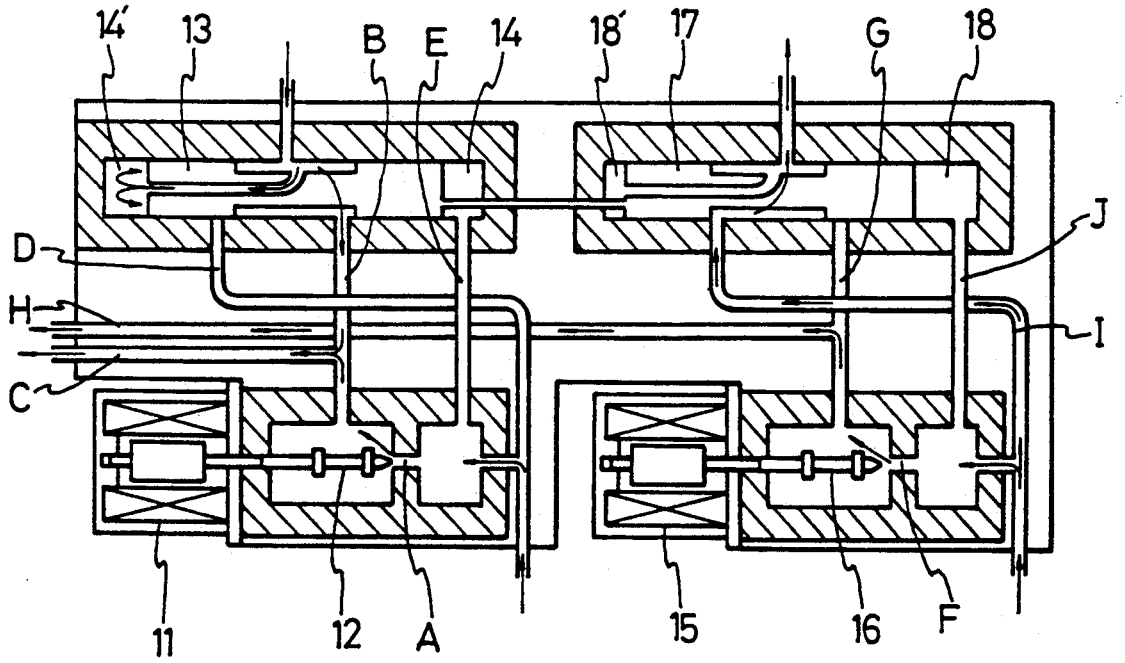
FIG. 10 is a view corresponding to FIG. 8, but showing a flow direction when a reaction force acts on the door during the opening operation of the system.

Here, if the opening switch is operated in case that the door 40 is not fully opened and the vehicle equipped with this system runs at a relatively low running speed not more than 10 km/h, an opening signal is applied from the opening switch to the controller 8 wherein a logic circuit operates in response to the signal and causes the left-side solenoid 11 to be driven as shown in FIG. 9. The needle 12 cooperating with the solenoid 11 thus moves rightwards so as to reduce the orifice area of the hydraulic passage A. In result, the pressurized oil applied from the oil pump 1 to the input side of the control valve 10 flows to the variable oil chamber 14 in the control valve 10 through a hydraulic line E, thereby causing the spool 13 to move leftwards and causing a hydraulic line D to communicate with the one oil chamber 31 of the hydraulic rotator 30.

Therefore, a part of the pressurized oil applied to the control valve 10 is supplied to the oil chamber 31 of the hydraulic rotator 30 through the opened hydraulic line D and this causes the inner pressure of the oil chamber 31 to be higher than that of the other oil chamber 32. The drive gear 25 of the hydraulic rotator 30 thus rotates counterclockwise as shown in FIG. 6 such that the oil in the other oil chamber 32 is discharged through a hydraulic line I communicating with this chamber 32 through the hole 23. The discharged oil in the hydraulic line I is then mixed with the pressurized oil applied from the oil pump 1 to the control valve 10 and the mixed oil in the line I is drained to the oil reservoir 2 through the opened hydraulic passage F and another drain line H communicating with the oil reservoir 2. Also, the drive gear 25 rotating counterclockwise about the drive shaft 21 causes the driven gear 29 engaging therewith to rotate clockwise about the driven shaft 27 following suit. At this time, the rotating driven gear 29 causes the lock bar 36 connected to the side surface thereof to move leftwards in order to release the locking state of the door 40 and continuously rotates together with the driven shaft 27 so as to drive the door 40 to be opened.

Briefly described, during the opening operation of the system, the inner pressure of the oil chamber 31 increases as the pressurized oil is applied from the oil pump 1 to the chamber 31 through the opened hydraulic line D of the control valve 10 and this causes the drive gear 25 to rotate counterclockwise about the drive shaft 21 and the driven gear 29 to rotate clockwise about the driven gear 27 following suit. In this case, the clockwise rotating driven gear 29 pulls leftwards the lock bar 36, which is connected thereto by the connection ring 35, to release the locking state of the door 40 with respect to the car frame, thereafter, continuously rotates clockwise together with the driven shaft 27 cooperating therewith by means of the stopper 35 so that the door 40 is opened by the clockwise rotation of the driven shaft 27 fixed to the door 40.

On the other hand, if the depression of the opening switch is stopped during the opening operation of the door 40 caused by the clockwise rotation of the driven shaft 27, the controller 8 is applied with no opening signal so that the logic circuit of the controller 8 stops the operation of the solenoid 11, thereby causing the solenoids 11 and 15 of the control valve 10 to be positioned so that the needle 12 fully opens the hydraulic passage A as shown in FIG. 8. In result, the pressurized oil applied from the oil pump 1 to the input side of the control valve 10 is drained to the oil reservoir 2 through the passages A and F and the drain lines C and H. At this time, the one oil chamber 31 of the hydraulic rotator 30 has the same inner pressure as that of the other oil chamber 32 as described above, thus, the drive gear 25 of the hydraulic rotator 30 stops its rotation about the drive shaft 21 and this causes the opening operation of the door 40 to be stopped.

In addition, when a reaction force is acted on the door 40 in the opening operation such as due to an obstacle, for example, a human body or a wall contacting with the outer surface of the door 40, the door 40 will stop the opening operation in case that the reaction force is stronger than the rotating force of the hydraulic rotator 30, while it is continuously opened in case that the reaction force is weaker than the rotating force of the hydraulic rotator 30. When the reaction force is stronger than the rotating force of the hydraulic rotator 30, the reaction force transmits to the driven gear 29 by way of the driven shaft 27 to intend to stop the rotation of the driven gear 29 and this causes the inner pressure of the other oil chamber 32 to be balanced with that of the one oil chamber 31. Hence as shown in FIG. 8, the pressurized oil applied from the oil pump 1 to the input side of the control valve 10 flows to the oil reservoir 2 through the passages A and F and the drain lines C and H and the door 40 stops its opening operation.

Also, if there occurs a manually closing force acting on the door 40 in the automatic opening operation, a reaction force caused by the manually closing force transmits to the driven gear 29 by way of the driven shaft 27 to intend to stop the rotation of the driven gear 29 as described in the reaction force caused by an obstacle. However at this time, the pressurized oil is continuously applied from the output side of the control valve 10 to the one oil chamber 31 of the hydraulic rotator 30 so that the inner pressure of the chamber 31 is abruptly increased and the inner pressure of the variable oil chamber 14' is suddenly increased following suit, which chamber 14' is formed at a side of the spool 13 and communicates with the oil chamber 31. The spool 13 thus moves rightwards so that simultaneously with cutting off the hydraulic line D through which the pressurized oil is to be supplied to the oil chamber 31 of the hydraulic rotator 30, the spool 13 opens the hydraulic line B so as to make the oil chamber 31 communicate with the oil reservoir 2. Therefore, the pressurized oil in the oil chamber 31 is discharged from the chamber 31 to the oil reservoir 2 through the lines B and C, thereby allowing the door 40 to be manual closed.

In other words, when the manually closing force is continuously acted on the door 40 under the condition that the hydraulic line D communicating with the one oil chamber 31 of the hydraulic rotator 30 is cut off while another hydraulic line B connecting the oil chamber 31 to the oil reservoir 2 is opened, the pressurized oil in the one oil chamber 31 is discharged through the hydraulic line B communicating with the variable oil chamber 14' formed at the side of the spool 13. At the same time, the other oil chamber 32 of the hydraulic rotator 30 is increased its volume by virtue of the manual closing force transmitted from the door 40 to the drive gear 25 and is supplied with the pressurized oil through the opened hydraulic line I of the control valve 10. In result, the door 40 in the automatic opening operation can be manually closed as required.

On the other hand, during the automatic opening operation of the system, if there is no reaction force acting on the door 40 due to the obstacle or the manual closing force, the door 40 is fully opened to a predetermined extent. In this case, the drive gear 25 fully rotates counterclockwise about the drive shaft 21 to a predetermined rotation angle to achieve such fully opening state and this causes a sensor pin 33 provided to the side surface of the drive gear 25 to contact with a sensor 34 in order to drive the sensor 34. Upon contacting with the pin 33, the sensor 34 outputs a signal corresponding to the fully opening state of the door 40 to the controller 8 wherein the logic circuit stops the operation of the solenoid 11 in response to the signal and causes the inner pressures of the oil chambers 31 and 32 of the hydraulic rotator 30 to be equal to each other. In result, the hydraulic rotator 30 and the door 40 stop their operations, respectively.

Figure 11:
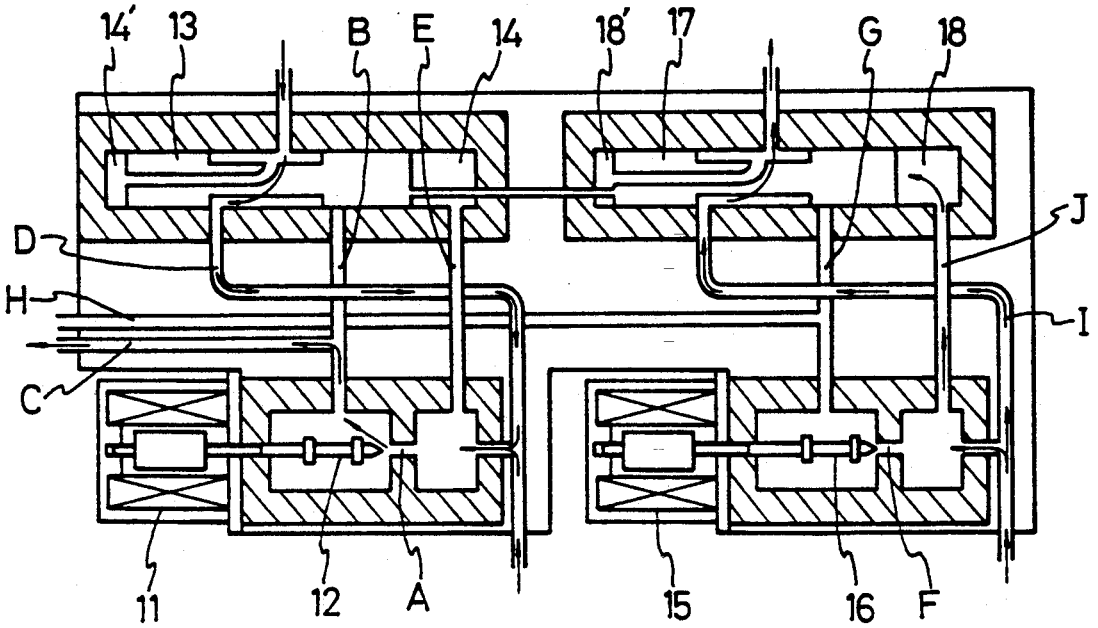
FIG. 11 is a view corresponding to FIG. 8, but showing a flow direction when the system performs the door closing operation.
Figure 12:
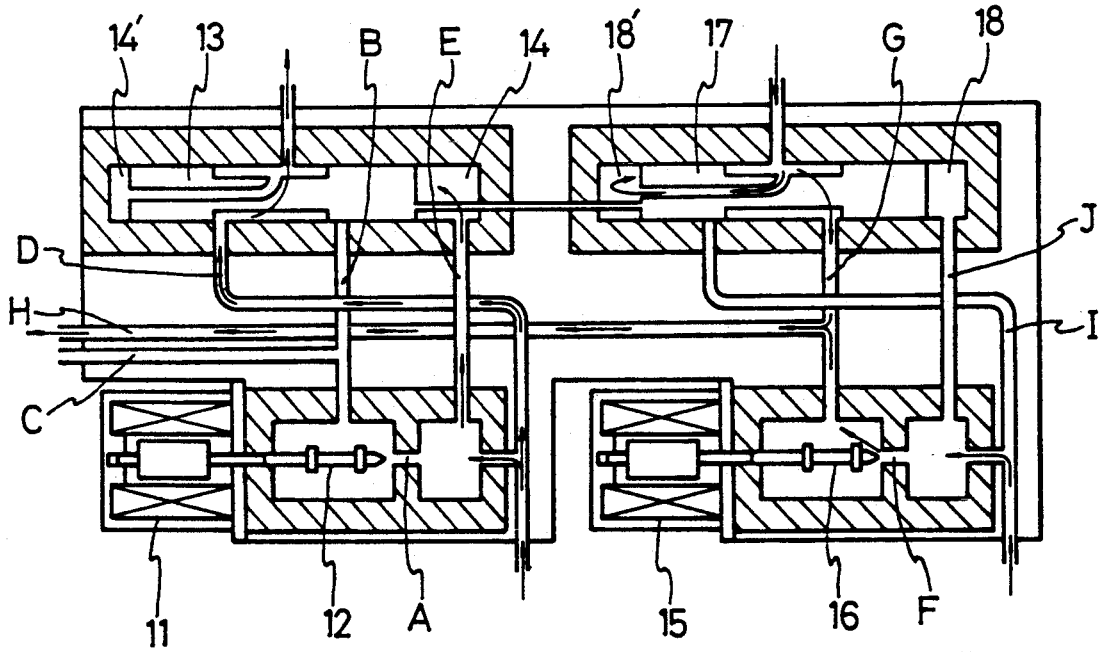
FIG. 12 is a view corresponding to FIG. 8, but showing a flow direction when a reaction force acts on the door during the closing operation of the system.

On the other hand, regardless of the running speed of the vehicle, if the closing switch equipped in the vehicle or the closing switch of the remote controller is operated under the condition that the door 40 is not fully closed, the closing switch outputs a closing signal to the controller 8 wherein the logic circuit causes the right-side solenoid 15 to be driven as shown in FIG. 11. The needle 16 cooperating with the solenoid 15 thus moves rightwards so as to reduce the orifice area of the hydraulic passage F, thereby making the door 40 be automatically closed.

That is, when the orifice area of the hydraulic passage F is reduced as described above, the spool 17 moves leftwards by the pressurized oil which is applied from the oil pump 1 to the input side of the control valve 10 and this causes the hydraulic line I to communicate with the other oil chamber 32 of the hydraulic rotator 30. In result, the pressurized oil outputted from the oil pump 1 is supplied to the oil chamber 32 through the hydraulic line I so that the inner pressure of the chamber 32 increases in order to rotate the drive gear 25 in the clockwise direction. As the drive gear 25 rotates clockwise, the oil in the one chamber 31 is discharged into the variable oil chamber 14', thus causing the spool 13 to move rightwards and the one chamber 31 to communicate with the oil reservoir 2 through the hydraulic line B. In the hydraulic line B, the discharged oil is then mixed with the pressurized oil supplied from the oil pump 1 and this mixed oil is discharged to the oil reservoir 2 through the drain line C.

Hence, the drive gear 25 of the hydraulic rotator 30 rotates clockwise about the drive shaft 21 and causes the driven gear 29 engaging therewith to rotate counterclockwise about the driven shaft 27 following suit. At this time, the driven gear 29 rotates counterclockwise together with the driven shaft 27 cooperating therewith by the stopper 35 so that the door 40 is closed by the counterclockwise rotation of the driven shaft 27 fixed to the door 40.

However, if the driver stops the pushing operation for the closing switch during the closing operation of the door 40 which is carried out by the rotation of the driven shaft 27, no closing signal is applied from the closing switch to the controller 8 wherein the logic circuit thus stops the operation of the solenoid 15, thereby causing the needle 12 to fully open the oil passage F. In result, the pressurized oil applied from the oil pump 1 to the input side of the control valve 10 is drained to the oil reservoir 2 through the drain lines C and H. At this time, the inner pressures of the oil chambers 31 and 32 are balanced to each other. The drive gear 25 of the hydraulic rotator 30 thus stops its rotation about the drive shaft 21 and this causes the closing operation of the door 40 to be stopped.

In addition, if a reaction force caused such as by a human body sandwiched between the door 40 in the closing operation and the car frame is acted on the door 40, the closing operation of the door 40 will be stopped in case that the reaction force is stronger than the rotating force of the hydraulic rotator 30 while it will be continued in case that the reaction force is weaker than the rotating force of the hydraulic rotator 30. When the reaction force is stronger than the rotating force of the hydraulic rotator 30, the reaction force transmits to the driven gear 29 by way of the driven shaft 27 fixed to the door 40 to intend to stop the rotation of the driven gear 29 and this causes the inner pressure of the oil chamber 31 to be balanced with that of the other oil chamber 32. Hence similar to the case in the opening operation of the door 40, the pressurized oil applied from the oil pump 1 to the input side of the control valve 10 is drained to the oil reservoir 2 through the drain lines C and H and this makes the door 40 stop its closing operation.

Also, if there occurs a manually opening force acting on the door 40 during the automatic closing operation, a reaction force caused by the manually opening force transmits to the driven gear 29 by way of the driven shaft 27 to intend to stop the rotation of the driven gear 29 as described above. However at this time, the pressurized oil is continuously applied from the control valve 10 to the oil chamber 32 of the hydraulic rotator 30 such that the inner pressure of the chamber 32 is abruptly increased and the inner pressure of a variable oil chamber 18' formed at a side of the spool 17 and communicating with the oil chamber 32 is suddenly increased following suit. The spool 17 thus moves rightwards so that simultaneously with cutting off the hydraulic line I through which the pressurized oil is supplied to the oil chamber 32, the spool 17 opens the hydraulic line G so as to make the oil chamber 32 to communicate with the oil reservoir 2. Therefore, the pressurized oil in the oil chamber 32 is discharged from the chamber 32 to the oil reservoir 2 through the lines G and H, thereby making it possible to manually open the door 40.

That is, when the manually opening force is continuously acted on the door 40 under the condition that the hydraulic line I communicating with the oil chamber 32 of the hydraulic rotator 30 is cut off while another hydraulic line G connecting the oil chamber 32 to the oil reservoir 2 is opened, the pressurized oil in the oil chamber 32 is discharged through the hydraulic line G communicating with the variable oil chamber 18' formed at the side of the spool 17. At the same time, the oil chamber 31 of the hydraulic rotator 30 is increased in its volume by virtue of the manual closing force transmitted from the door 40 to the drive gear 25 and is supplied with the pressurized oil through the opened hydraulic line D of the control valve 10. In result, the door 40 in the automatic closing operation can be manual opened as required.

On the other hand, during the automatic closing operation, if there is no reaction force acting on the door 40 due to the obstacle sandwiched between the door 40 and the car frame or a manually opening force, the door 40 is fully closed to a predetermined extent. At this state, the drive gear 25 fully rotates clockwise about the drive shaft 21 to a predetermined rotation angle and this causes the sensor pin 33 of the drive gear 25 to contact with the sensor 34. Upon contacting with the sensor pin 33, the sensor 34 outputs a signal indicating the complete closure of the door 40 to the controller 8 wherein the logic circuit stops the operation of the solenoid 15 of the control valve 10 in response to the signal and causes the inner pressures of the oil chambers 31 and 32 of the hydraulic rotator 30 to be equal to each other. The hydraulic rotator 30 and the door 40 thus stop their operations, respectively.

The lock bar 36, which is prepared for the exact locking of the door 40 with respect to the car frame, is provided with the biasing member 37, such as a tension coil spring, connected between the lock bar 36 and the door 40 as described above so that the lock bar 36 always locks the door 40 with respect to the vehicle frame without failure. In addition, the lock bar 36 includes at its center portion the release lever 38 having the similar structure to the conventional release lever. The door 40 can be thus manually opened or closed as required.

Figure 13:
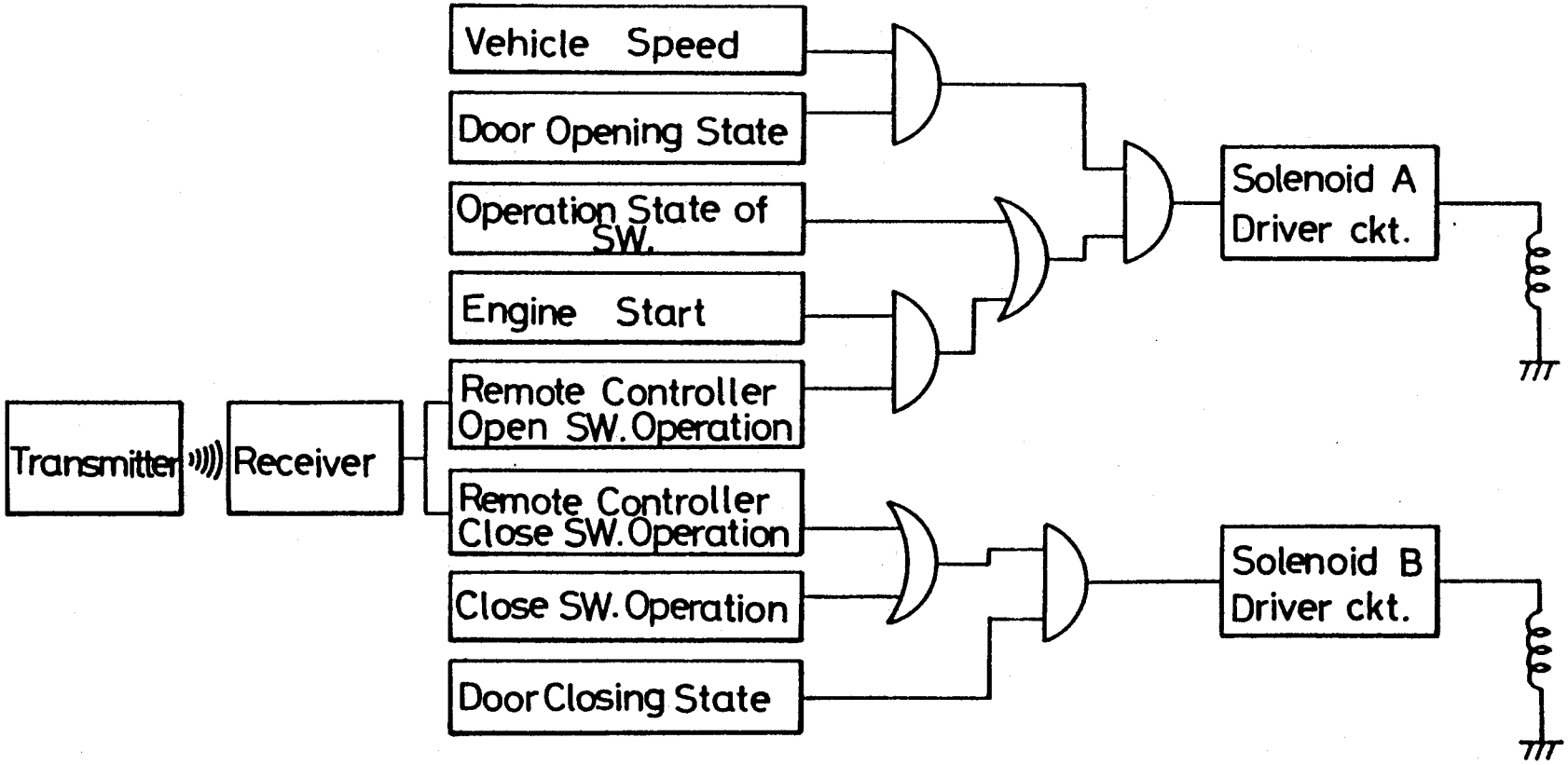
FIG. 13 is a schematic diagram of a logic circuit which is provided in a controller and controls solenoids of the control valve.

On the other hand, FIG. 13 shows a schematic diagram of the logic circuit which is provided in the controller 8 and controls the solenoids 11 and 15 of the control valve 10 in response to signals, corresponding to the running speed of the vehicle, the opening and closing states of the door 40, the operational states of the opening and closing switches, the operational states of the opening and closing switches of the remote controller, the engine operational state and the like, applied to the controller 8. The logical operation values of the logic circuit are given in Table 1.

TABLE 1

| Content | State | (Logical operation values) Values* | Remarks |
|---|---|---|---|
| Vehicle Running Speed, S | S ≦ 10 km/h<br>S > 10 km/h | T<br>F | Sensed by Vehicle speed sensor |
| Door opening state | not fully opened<br>fully opened | T<br>F | Sensed by first sensor |
| Door closing state | not fully closed<br>fully closed | T<br>F | Sensed by second sensor |
| Operation State of Open SW. | In operation<br>In non-operation | T<br>F | |
| Operation State of Close SW. | In operation<br>In non-operation | T<br>F | |
| Operation State** | In operation<br>In non-operation | T<br>F | Sensed by receiver of Rem. Cont. |
| Operation State*** | In operation<br>In non-operation | T<br>F | Sensed by receiver of Rem. Cont. |
| Engine State | In operation<br>In non-operation | T<br>F | Sensed by start SW. of Engine |

*Logical values
**Operation state of the open switch of the remote controller
*Operation state of the close switch of the remote controller Therefore, if the opening switch equipped in the vehicle or the opening switch of the remote controller is operated when the running speed of the vehicle is not more than 10 km/h and the door 40 is not fully opened, that is, the door 40 can be more opened, the solenoid 11 of the control valve 10 is driven to cause the pressurized oil which is applied from the oil pump 1 to the input side of the control valve 10 to be supplied to the one oil chamber 31 of the hydraulic rotator 30, thereby making the door 40 be automatically opened. On the contrary, regardless of the running speed of the vehicle, if the closing switch in the vehicle or the closing switch of the remote controller is operated when the door 40 is not fully closed, that is, the door 40 can be more closed, the solenoid 15 of the control valve 10 is driven to cause the pressurized oil which is applied from the oil pump 1 to the control valve 10 to be supplied to the other oil chamber 32 of the hydraulic rotator 30, thereby making the door 40** be automatically closed.

As described above, the present invention provides hydraulic system for automatically, manually opening and closing the doors of a vehicle, especially a small-size vehicle, in which the pressurized oil outputted from an oil pump is supplied to an intermittent gearing assembly, comprising a drive intermittent gear and a driven intermittent gear, by way of a pressure control valve, a solenoid valve, which controls the flow direction of the pressurized oil in response to a signal outputted from a switch equipped in the vehicle or a switch of a remote controller to the control valve by way of a controller, thereby causing the intermittent gearing assembly to rotate so as to drive the door of the vehicle to be automatically opened or closed. In result, the system of this invention provides an advantage in that it makes the doors of the vehicle be automatically opened or closed by control using the switch in the vehicle or the remote controller. In addition, the system of this invention makes it possible to manually reverse the automatic opening or closing operation of the door so that it provides an additional advantage in that it conveniently carries out the opening and closing operations of the doors of the vehicle and efficiently prevents the human body or the doors from being injured or damaged.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. A system for automatically opening and closing a door of a vehicle, comprising:

a hydraulic pump for pressurizing oil supplied from an oil reservior connected thereto;

a pressure accumulator connected to said hydraulic pump for removing a pressure pulsation generated in the pressurized oil outputted thereto from said hydraulic pump, said pressure accumulator thereby being disposed on an output side of the hydraulic pump;

a pressure control valve, connected to said hydraulic pump and pressure accumulator for controlling a flow direction of the pressurized oil which is applied thereto from the hydraulic pump in communication with said pressure accumulator;

a controller electrically connected to said pressure control valve for controlling same in response to input signals;

an intermittent gearing assembly means for transmitting a rotational motion, induced by the pressurized oil supplied from said control valve, to open and close said door, said intermittent gearing assembly means comprising a cylindrical drive intermittent gear rotatable about a drive shaft fixed to a vehicle frame and a cylindrical driven intermittent gear engaging said drive intermittent gear for co-rotation therewith, said driven gear being mounted on a driven shaft fixed to the door which driven shaft is rotatable with the driven gear;

a hydraulic rotator formed by the drive gear and drive shaft for converting the hydraulic power of the pressurized oil into the rotational motion of said intermittent gearing assembly means through rotation of said drive gear, said hydraulic rotator comprising a pair of variable oil chambers which are formed in said drive intermittent gear and communicate with said pressure control valve to receive pressurized oil therefrom; and a longitudinal lock bar for locking the door to the vehicle frame, said longitudinal lock bar being connected at an end thereof to a connection ring provided at an outer surface of the driven intermittent gear.

2. The system according to claim 1, wherein said pressure accumulator includes a housing enclosing a piston which is provided with an oil ring and divides the inner space of said housing into an upper part and a lower part, the upper part being charged with a high pressure gas and the lower part communicating with a hydraulic line between said oil-hydraulic pump and said control valve to thereby remove the pressure pulsation from the pressurized oil flowing in said hydraulic line.

3. The system according to claim 1, wherein said pressure control valve comprises:

a pair of solenoids having a movable needle, respectively, for controlling the flow direction of the pressurized oil which is applied from the oil pump to an input side of the pressure control valve; and a pair of movable spools for opening or closing a plurality of hydraulic lines inside the pressure control valve, respectively, each said spool moving leftwards and rightwards in accordance with the controlled flow direction of the pressurized oil.

4. The system according to claim 1, further comprising a spacer for spacing said drive and driven shafts of the intermittent gearing assembly means apart from each other by a predetermined distance, and wherein the driven shaft includes a stopper by which the rotational motion of the driven intermittent gear first causes said lock bar to be pulled in order to release the locking state of the door whereupon said rotational motion is then transmitted to the driven shaft to rotate it together with the driven intermittent gear.

5. The system according to claim 1, wherein said variable oil chambers of the hydraulic rotator are formed by providing a stationary partition on said drive shaft and a movable partition on said drive intermittent gear, said movable partition radially inwardly projecting from an inner surface of the drive intermittent gear and said stationary partition radially outwardly projecting from an outer surface of the drive shaft and having a pair of oil circulation holes for causing the pressurized oil applied from said pressure control valve to flow in the variable oil chambers.

6. The system according to claim 1, wherein said lock bar includes a release lever for manually opening the door and an elastic biasing member for elastically restoring the lock bar to the locking state with respect to the vehicle frame.

7. The system according to claim 1, wherein said system further comprises:

a first sensor for sensing a full opening state of the door and outputting a said input signal corresponding to the full opening state to said controller, said first sensor being driven by a pin which is mounted on an outer surface of said drive intermittent gear; and a second sensor for sensing a full closing state of the door and outputting another said input signal corresponding to the full closing state to the controller, said second sensor being mounted on a portion of the vehicle frame facing a free end of the door so as to be driven by the door.

* * * * *